United States Patent [19]

Carson

[11] Patent Number: 4,536,276

[45] Date of Patent: Aug. 20, 1985

[54] HYDROGEN CONSERVATION IN HYDROGEN RECYCLE HYDROCONVERSION PROCESSES

[75] Inventor: Don B. Carson, Mt. Prospect, Ill.

[73] Assignee: UOP Inc., Des Plaines, Ill.

[21] Appl. No.: 625,416

[22] Filed: Jun. 28, 1984

Related U.S. Application Data

[62] Division of Ser. No. 374,858, May 4, 1982, Pat. No. 4,476,094.

[51] Int. Cl.[3] ..... C10G 47/36; C10G 45/72

[52] U.S. Cl. ..... 208/100; 208/DIG. 1; 208/108; 208/143; 208/213; 585/250; 585/483

[58] Field of Search ..... 208/DIG. 1, 100, 103, 208/105, 108, 133, 142, 134, 143, 209, 213; 585/250, 483, 616, 654

[56] References Cited

U.S. PATENT DOCUMENTS

| | | | |
|---|---|---|---|
| 3,653,842 | 4/1972 | Putman | 202/160 |
| 3,656,911 | 4/1972 | Hobbs | 260/700 |
| 3,974,064 | 8/1976 | Bajek et al. | 208/134 |
| 3,979,183 | 9/1976 | Scott | 196/132 |
| 3,981,793 | 9/1976 | Christie et al. | 208/108 |

*Primary Examiner*—D. E. Gantz
*Assistant Examiner*—O. Chaudhuri
*Attorney, Agent, or Firm*—Thomas K. McBride; William H. Page, II; Richard J. Cordovano

[57] ABSTRACT

There is disclosed a system for measuring and controlling the concentration of hydrogen in hydrogen recycle processes used in oil refineries and petrochemical plants. The system is intended to permit reduction in hydrogen use in hydrogen-consuming hydrogen recycle processes. The system is dependent on the recognition that a decrease in cooling medium temperature results in an increase in vent gas flow, which can be decreased to the minimum permissible without endangering catalyst activity and stability and product yield if hydrogen concentration is monitored, and that partial pressure is the key parameter.

8 Claims, 2 Drawing Figures

HYDROGEN CONSERVATION IN HYDROGEN RECYCLE HYDROCONVERSION PROCESSES

CROSS REFERENCE TO RELATED APPLICATION

This is a Divisional application of pending application Ser. No. 374,858 filed on May 4, 1982 now U.S. Pat. No. 4,476,094.

BACKGROUND OF THE INVENTION

This invention relates to conservation of hydrogen in hydrogen recycle processes used in oil refineries and petrochemical plants. More specifically, the invention relates to a method, applicable only to hydrogen-consuming hydrogen recycle processes, of reducing the amount of hydrogen vented from the processes. Hydrogen recycle processes can be classified into two types: those which produce hydrogen and those which consume hydrogen. Examples of hydrogen-producing processes are catalytic reforming and the various dehydrogenation processes. Hydrogen-consuming processes include hydrogenation, hydrodealkylation, hydrodesulfurization, hydrocracking, and isomerization. FIGS. 1 and 2, which are presented herein as examples, show the basic flow arrangement of hydrogen-consuming hydrogen recycle processes. A circulating gas flow consisting mainly of hydrogen and including hydrocarbon vapors is maintained in the equipment loop by means of a compressor. A hydrocarbon charge stock stream and a hydrogen stream are added to the loop. A liquid product stream and a vent stream are removed from the loop. It is desirable to maintain the concentration of hydrogen in the reactor above a certain minimum value for each particular process in order to protect catalyst activity and stability and/or product yield structure. These minimum values are known to those skilled in the art by means of experimental data which has been collected by them. If the hydrogen concentration falls below the minimum value in a process where the reactor contains catalyst, the result will be excessive deposit of coke on the catalyst, premature deactivation of the catalyst, and reduction of product yield. In those processes which do not utilize a catalyst, the hydrogen concentration must be maintained above the minimum value in order to protect the yield structure, that is, to maximize the amount of desired product produced by the processing unit and minimize the production of undesirable by-products. A standard method for maintaining the required minimum hydrogen concentration is to control the rate at which gas in circulated by adjusting compressor capacity and to control vent gas flow. The operator of the hydrocarbon processing unit monitors the quantity of circulating gas flowing by means of a flow indicator and manually adjusts compressor capacity. Alternatively, an automatic flow controller can be used to maintain the quantity flowing at an appropriate value above the minimum. An automatic flow control loop is used to control the vent flow at a previously determined value. The vent flow is made necessary by the presence of light hydrocarbons in the circulating gas stream. Some light hydrocarbons enter the system as part of the hydrogen feed stream, which is not pure hydrogen, and some are produced in side reactions taking place in the reactor. While some of the light hydrocarbons leave the system dissolved in the liquid stream, there is usually an increase in concentration over time unless a vent stream is employed. Thus the purpose of the vent stream is to remove light hydrocarbons from the process, as they would interfere with the desired reactions. The principle is similar to that of cooling tower blow-down, where a continuous stream of water is withdrawn to keep water hardness at an acceptably low level. The vent stream usually contains 60 mole percent or more of hydrogen, so there is a significant hydrogen loss from the system. The vented gas is usually routed to the refinery fuel gas system. However, hydrogen has more value in the process than it does as fuel, so that it is economically desirable to reduce the amount vented.

Variations in cooling efficiency lead to an excessive vent gas flow. The cooling medium used in the cooler, which is part of the equipment loop shown in FIGS. 1 and 2, is water or ambient air. The temperature of the cooling medium varies with weather conditions and time of day and can vary from hour to hour. As the cooling medium temperature falls, a larger quantity of hydrocarbon vapor condenses out of the cooled stream, thus causing the concentration of hydrogen in the circulating stream to increase. The average molecular weight of the circulating gas decreases as hydrogen concentration increases. The flow meter used is normally of the orifice type. As can be seen from an inspection of the well-known orifice flow meter equation and the example presented herein, a lower molecular weight of the flowing gas results in a lower flow reading. This lower flow reading causes the automatic controller to increase vent gas flow in order to bring the flow reading back up to its proper value. However, the flow reading is not an accurate indication of hydrogen concentration, because of the changed molecular weight, and the effect is an increase in vent gas flow which is not necessary to protect the catalyst and does not serve any other desired purpose. Thus a decrease in the temperature of a cooling medium which is capable of varying from hour to hour results in an unnecessarily large vent gas flow. Variations in cooling efficiency lead to an excessive loss of hydrogen by means of the false decrease in vent flow indication due to lower average molecular weight. It is possible to control circulating gas composition at a constant value by regulating the quantity of cooling medium passed through the cooler. However, this is not usually a desirable option, since a colder cooling medium yields a colder gas-liquid separator, which enhances liquid product recovery and the purity of the circulating gas. Also, a colder gas-liquid separator results in less hydrogen being dissolved in the liquid product stream and therefore lost from the system.

The art which has been discovered which is closest to the instant invention is disclosed by Bajek and McLaughlin in U.S. Pat. Nos. 3,974,064 and 3,972,804. These patents present a comprehensive control scheme for hydrogen recycle processes. The instant invention can be considered an improvement on those inventions. Those effects of changes in cooling medium temperature which are adverse are recognized and control action is taken to mitigate them. The key process parameter of partial pressure is recognized and used to initiate control action. An excessively large safety margin in hydrogen concentration is not necessary.

BRIEF SUMMARY OF THE INVENTION

It is an object of this invention to provide a means of reducing hydrogen usage in hydrogen consuming hydrogen recycle processes by reducing the amount of hydrogen vented. The concentration of hydrogen is obtained and used to adjust the flow rate of the vent stream so that the concentration of hydrogen is at the minimum required to protect the catalyst and/or maintain the yield structure. In one of its broad aspects, the present invention embodies a method consisting of (a) monitoring the concentration of hydrogen in a hydrogen recycle process; (b) comparing said concentration of hydrogen to a previously established value; and (c) adjusting the flow rate of a vent stream in response to said comparison to provide a concentration which is equal to said previously established value. In a more specific embodiment of the present invention, the concentration of hydrogen in the reactor is expressed in terms of partial pressure and is obtained by means of measuring the total pressure of the feed stream, measuring the mole fraction of hydrogen in the feed stream, then multiplying mole fraction times total pressure, the product being partial pressure. Other objects and embodiments will become apparent upon consideration of this entire specification.

BRIEF DESCRIPTION OF THE DRAWINGS

FIG. 1 depicts a mode of practicing the invention wherein a partial pressure detection apparatus is used to measure the concentration of hydrogen.

FIG. 2 depicts a mode of practicing the invention wherein the partial pressure of hydrogen is calculated from measurements of total pressure and mole fraction. Note that the dashed lines represent transmission of control signals to and from items of control hardware and that solid lines drawn to the circles representing instruments denote pipelines containing process fluid.

DETAILED DESCRIPTION OF THE INVENTION

Figure 1:
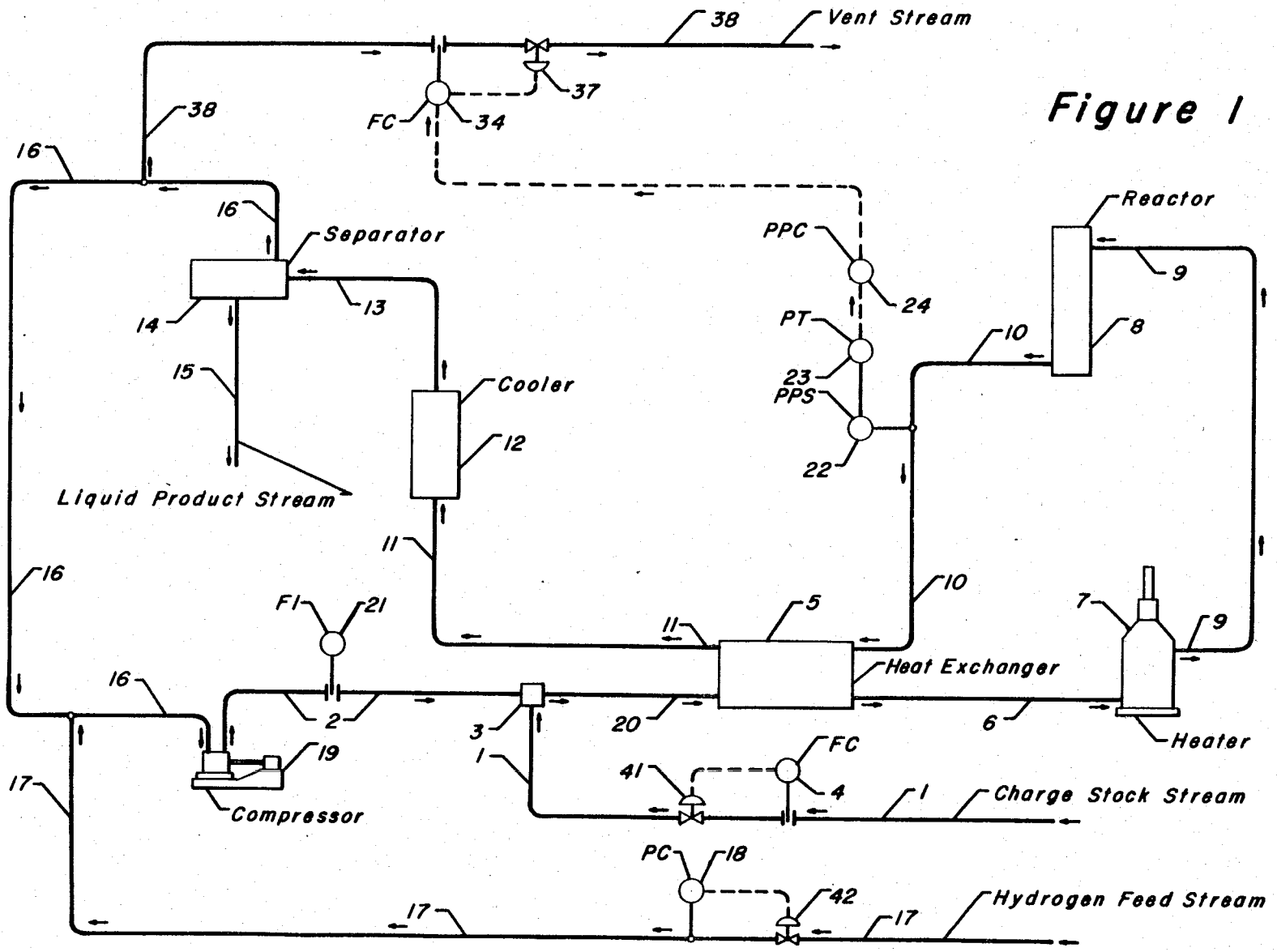
FIGS. 1 and 2 depict typical flow schemes for hydrogen consuming hydrogen recycle processes used in oil refineries and petrochemical plants.
Figure 2:
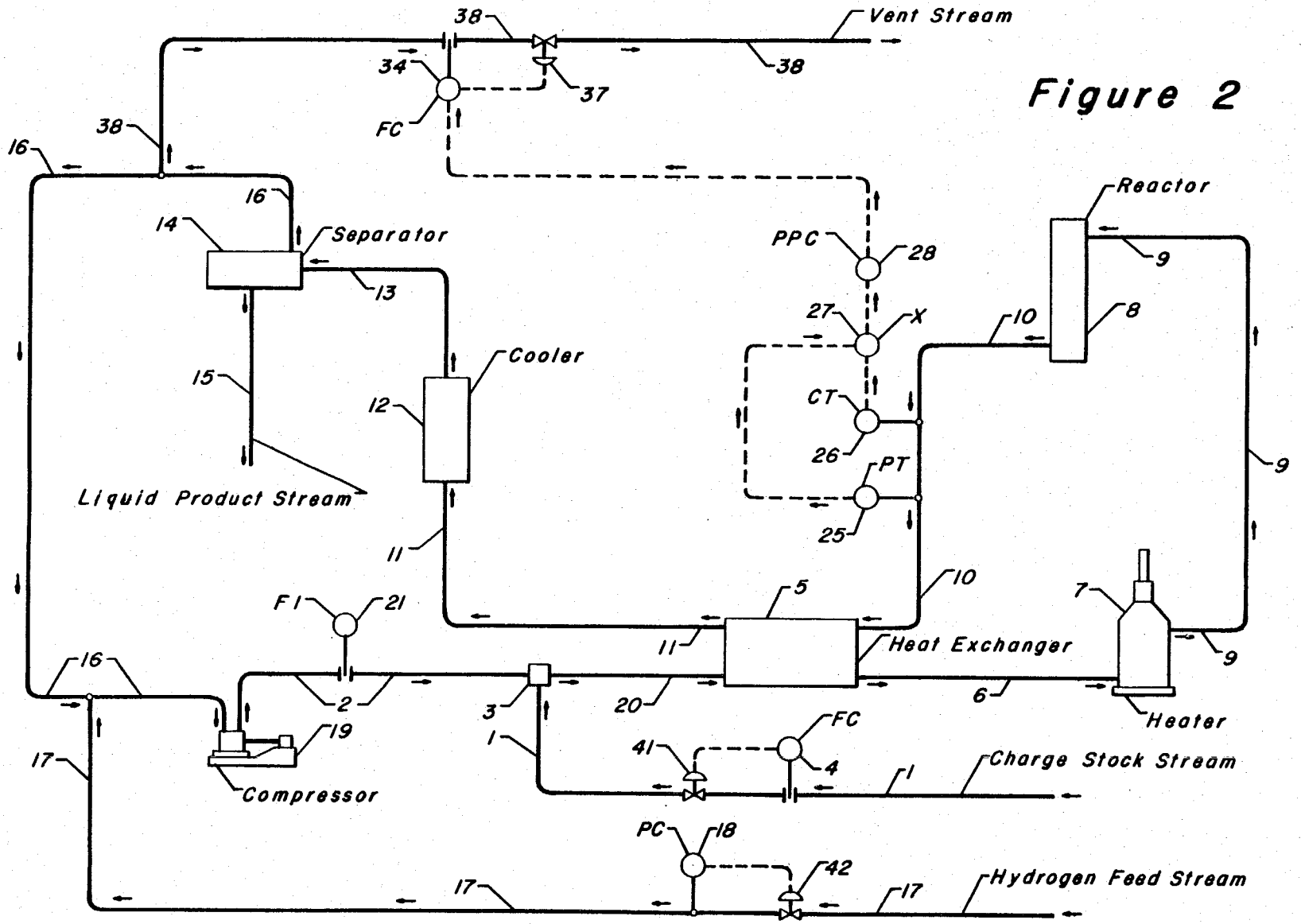

The further description of this invention is presented with reference to the schematic drawings, FIGS. 1 and 2. The drawings are not intended as an undue limitation on the generally broad scope of the invention as set out in the claims. Only those compressors, heaters, heat exchangers, and coolers are shown that are useful in the description of the process. The depiction of other miscellaneous hardware such as pumps, instrumentation and controls, and valves has been omitted as not essential to a clear understanding of the process, the use of such hardware being well within the purview of one skilled in the art.

In FIG. 1, a charge stock stream enters the processing unit through pipeline 1 and is mixed with circulating gas flowing in pipeline 2 by means of mixing pipeline section 3 to form a reactor feed stream in pipeline 20. The rate of charge stock addition is controlled at a particular preset value by flow controller 4 and flow control valve 41. The circulating gas stream flowing in pipeline 2 consists mainly of hydrogen but includes hydrocarbon vapors. The reactor feed stream flows through pipeline 20 to regenerative heat exchanger 5, where it is heated, and then through pipeline 6 to heater 7. The feed stream is heated further in heater 7 and then flows through pipeline 9 to reactor 8, where the desired reactions take place. The effluent stream produced in reactor 8 flows through pipeline 10 to regenerative heat exchanger 5 where it is cooled by giving up its heat to the reactor feed stream. From regenerative heat exchanger 5, the product stream flows through pipeline 11 to cooler 12 where it is further cooled by means of a cooling medium which is water or ambient air. As a result of this cooling, liquid hydrocarbons are condensed. The effluent stream flows from cooler 12 through pipeline 13 to gas-liquid separator 14 where it separates into two streams—a liquid product stream which flows out of the hydrocarbon processing unit through pipeline 15 and a hydrogen and hydrocarbon vapor stream, a portion of which flows through pipeline 16 to compressor 19. Pipeline 17 is connected to pipeline 16 and is used to supply hydrogen to the hydrocarbon processing unit from a source outside of the unit. Pressure controller 18 and pressure control valve 42 regulate the addition of hydrogen so that a constant preset pressure will be maintained at the suction of compressor 19. As hydrogen is consumed in the reactor, the pressure decreases, causing the valve to open to allow hydrogen to flow into the hydrocarbon processing unit. Flow indicator 21 provides a measurement of gas flow at the outlet of compressor 19 so that an operator can manually adjust compressor output by reference to it. Compressor output is changed by adjusting the speed of the compressor or by adjusting inlet guide vanes. Alternatively, an automatic controller can be used to monitor the quantity of circulating gas flowing and adjust the capacity of the compressor to maintain the quantity flowing at an appropriate value above the minimum. Hydrogen and hydrocarbon vapor flow out of the hydrocarbon processing unit through pipeline 38. The flow is controlled by flow control valve 37 and flow controller 34 to a value set by the plant operator. The vent flow is made necessary by the presence of light hydrocarbons in the circulating gas stream. Some light hydrocarbons enter the system through pipeline 17 as part of the hydrogen feed stream, which is not pure hydrogen, and some are produced in side reactions taking place in reactor 8. While some of the light hydrocarbons leave the system dissolved in the liquid product stream, there is usually an increase in concentration over time unless a vent stream is employed. Thus the purpose of the vent stream is to remove light hydrocarbons from the process, as they would interfere with the desired reactions. The principle is similar to that of cooling tower blowdown, where a continous stream of water is withdrawn to keep water hardness at an acceptably low level. The vent stream usually contains 60 mole percent or more of hydrogen, so there is a significant hydrogen loss from the system. The vented gas is usually routed to the refinery fuel gas system. Hydrogen has more value in the process than it does as fuel, so that it is economically desirable to reduce the amount vented.

FIG. 1 shows the instrumentation necessary to practice an embodiment of the invention. Hydrogen concentration can be expressed as partial pressure of hydrogen. The partial pressure of hydrogen in the effluent stream in pipeline 10 is measured by a partial pressure sensor 22 such as that disclosed by H. A. Hulsberg in U.S. Pat. Nos. 2,671,336 and 2,671,337. Pressure transmitter 23, of conventional design, is used in conjunction with partial pressure sensor 22 and provides a signal to a conventional automatic controller 24 which adjusts the flow of vent gas by means of adjusting the set point of flow controller 34 rather than directly adjusting valve position. This is a conventional application of cascade control in order to curb excessive fluctuation of system parameters. When the partial pressure of hydrogen is higher than required, the vent gas flow is decreased, thus conserving hydrogen and reducing the concentration of hydrogen in the circulating gas stream by operation of two mechanisms: an increase in the light hydrocarbon concentration due to decreased removal and a decrease in hydrogen flow to the unit due to the operation of pressure controller 18 and pressure control valve 42. Thus only the amount of hydrogen is vented that is required to meet the minimum necessary to protect the catalyst and/or maintain the yield structure. Each of the equipment items shown in FIGS. 1 and 2 may consist of several individual pieces of equipment. For example reactor 8 may consist of a single vessel or may consist of several reaction vessels with provisions to reheat the process stream between vessels. Also, equipment may be added to this basic flow scheme. For example, the circulating gas stream may be passed through equipment designed to remove hydrogen sulfide. These variations and additions to the basic simple schematic are well known to those skilled in the art of hydrocarbon processing.

FIG. 2 is identical to FIG. 1 except for the method and instruments used to measure partial pressure. The pressure in pipeline 10 is sensed by a conventional pressure transmitter 25. The mole fraction of hydrogen in pipeline 10 is sensed by concentration transmitter 26, which may be a conventional thermal conductivity analyzer such as the 7C series sold by Beckman Instruments, Inc. The product of pressure times mole fraction, which is partial pressure, is obtained in multiplying relay 27. Automatic controller 28 adjusts the set point of flow controller 34.

In the case of processes which consume a substantial amount of hydrogen, it is desirable to locate the sensing point to obtain close control of hydrogen concentration. Since the reaction consumes hydrogen, the hydrogen concentration will decrease from the inlet to the outlet of the reactor means. The point of lowest hydrogen concentration will be at the outlet of the reactor means, i.e., in the reactor effluent stream. In contrast, in a hydrogen-producing process, the point of lowest hydrogen concentration will be at the entrance to the reactor means. The hydrogen concentration should be measured at the point where it is expected to be lowest in order to achieve the goal of maintaining as low as possible a concentration in order to conserve utilities while still protecting the catalyst and/or yield structure. In some cases, it may be desirable to vary the location of the hydrogen concentration sensor. The sensor can be located in pipeline 11 rather than in pipeline 10. The reason for changing sensor location would normally be to expose it to less severe conditions. The considerations involved in choice of sensor location are familiar to those skilled in the art. For example, it must not be placed in pipeline 11 if liquid drops condense out in heat exchanger 5.

The functions performed by the automatic controllers and arithmetic relays shown in FIGS. 1 and 2 can be accomplished by a digital computer which would receive process measurements and provide control signals in place of the automatic controllers and arithmetic relays. The method of practicing the invention is not changed by substitution of a digital computer for the automatic controllers and arithmetic relays and the depiction of controllers and relays in the Figures can be taken as showing computer functions. With use of a digital computer, different control algorithms are possible which might prove more efficient under certain circumstances. Control by a digital computer or microprocessor-based control units are included within the scope of this invention.

It is important to note that partial pressure is the parameter most relevant to protection of catalyst and yield structure. The invention can be practiced using any convenient method of measuring hydrogen concentration. However, for maximum precision, concentration of hydrogen should be expressed in terms of partial pressure. In the context of this invention, partial pressure is considered to be a form of expression of concentration. Often, the concentration of hydrogen can be measured by any convenient means without any loss of precision, since system pressure is relatively constant. But mole fraction, volume percent, and the like, do not completely correlate with improvement of catalyst activity and stability and yield. Pressure must be taken into account. If the amount of hydrogen in the circulating gas stream is held constant and the pressure is increased, the partial pressure of hydrogen increases. Catalyst activity and stability and yield will be improved by the pressure increase, though percent hydrogen has not changed.

The following example will be useful to illuminate the invention. The following table presents certain operating parameters for a hydrogen-consuming hydrogen recycle process, more specifically a vacuum gas oil hydrotreater processing 45,000 barrels per day of vacuum gas oil.

| | CASE A | CASE B | CASE C |
|---|---|---|---|
| Separator Temperature, °F. | 150 | 125 | 125 |
| Hydrogen Feed, lb-mol/hr | 2235.52 | 2241.82 | 2171.64 |
| Hydrogen Feed, $10^6$ SCFD | 20.36 | 20.42 | 19.78 |
| Vent Orifice DP, inches water | 42 | 42 | 24.85 |
| Vent Gas Rate, lb-mol/hr | 299.90 | 306.98 | 232.74 |
| Vent Hydrogen Rate, lb-mol/hr | 263.51 | 272.48 | 204.79 |
| Vent Hydrogen Rate, $10^6$ SCFD | 2.4 | 2.48 | 1.865 |
| Circulating Orifice DP, inches water | 42 | 42 | 42 |
| Circulating Gas Rate, lb-mol/hr | 5813.67 | 5936.11 | 5864.06 |
| Circulating Hydrogen, lb-mol/hr | 5108.23 | 5269.02 | 5159.79 |
| Circulating Hydrogen, $10^6$ SCFD | 46.52 | 47.99 | 46.99 |
| Circulating Gas Mol. Wt. | 4.02 | 3.84 | 3.95 |
| Gas to Reactor, lb-mol/hr | 8049.18 | 8177.93 | 8035.70 |
| Hydrogen to Reactor, lb-mol/hr | 7276.68 | 7443.59 | 7266.28 |
| Gas to Reactor, lb/hr | 28,812 | 28,238 | 28,461 |
| Hydrogen Partial Pressure, psia | 623 | 632 | 623 |
| Compression Load, hp | BASE | +19 | −43 |
| Equiv. Comp. Load, $10^6$ BTU/hr | BASE | +0.142 | −0.32 |
| Heating Load × 1/0.85, $10^6$ BTU/hr | BASE | +0.129 | −0.08 |
| Equiv. Feed Gas Load, $10^6$ BTU/hr | BASE | +1.11 | −10.73 |
| Equiv. Vent Gas Load, $10^6$ BTU/hr | BASE | +1.07 | −7.17 |
| Total Equiv. Load, $10^6$ BTU/hr | BASE | +0.31 | −3.96 |

Note that the hydrogen feed stream is 97% hydrogen and not all of the feed is vaporized before reaching the reactor. The concept of equivalent load is used to place the variables on a equalized basis for comparison. Horsepower is converted to equivalent load in BTU/hr by assuming that the compressor or compressors are electrically driven and that an electric utility must fire 10,000 BTU in order to deliver 1 kilowatt-hour. Theoretical heating load is adjusted by a factor to account for the efficiency of the heater. At the particular oil refinery or petrochemical plant of this example, hydrogen-rich feed gas is valued at 18.5 BTU/hr for each SCFD of feed gas while vent gas is assigned a value of 13.4 BTU/hr for each SCFD of hydrogen in the vent gas when the vent gas is used as fuel. Case A shows parameters when the unit is operating at design conditions, including the design maximum cooling medium temperature, at which the gas-liquid separator temperature will be 150° F. Orifice DP refers to the pressure drops across the orifice plates used in the vent stream circulating gas stream, the significance of which is explained earlier. The circulating gas parameters are taken at the compressor outlet.

Case B shows the parameters when the cooling medium temperature is such that the gas-liquid separator is operating at 125° F. and the invention is not practiced. Vent orifice pressure drop is maintained at the same value by the flow control loop. The amount of hydrogen feed required has increased from Case A, as has total equivalent load.

Case C shows the savings resulting when separator temperature is the same as in Case B but the invention is practiced. Feed gas consumption is decreased. Utilities savings are also realized. If we consider that the difference between Case B and Case C can be realized, on the average, for 330 days per year and that a realistic 1981 value is $5.00 per milion BTU's, the cost saving due to practicing the invention is $157,000.

I claim as my invention:

1. A control method for reducing the vent flow of hydrogen in hydrocarbon conversion apparatus, thereby reducing usage of hydrogen in said conversion apparatus, where said conversion apparatus comprises (1) a conduit for transporting a charge stock stream comprising hydrocarbons in communication with a conduit for transporting a recycle hydrogen-hydrocarbon stream to mix said hydrocarbon charge stock stream with said recycle hydrogen-hydrocarbon stream; (2) a hydrocarbon reaction zone in communication with said charge stock stream conduit for converting said hydrocarbons in said charge stock to a converted hydrocarbon product; (3) a cooling zone in communication with said reaction zone, via a reaction zone effluent conduit, to cool said reaction zone product to form a cooling zone effluent stream comprising a liquid product component and a vaporous hydrogen-hydrocarbon component; (4) a separation zone in communication with said cooling zone, via a cooling zone effluent conduit, to separate said cooling zone effluent stream into a liquid product stream, which is withdrawn from the process, and a vaporous hydrogen-hydrocarbon stream which flows in a separation zone vaporous effluent conduit, wherein said vaporous stream is divided into at least a portion of said recycle hydrogen-hydrocarbon stream and vent hydrogen-hydrocarbon stream; (5) a compressor means in interconnection with said separation zone, via said separation zone vaporous effluent conduit, and also in interconnection with said charge stock conduit via said recycle hydrogen-hydrocarbon stream conduit; (6) a vent conduit in communication with said separation zone vaporous effluent conduit, having an automatically variable flow restriction device therein, for removal of a portion of said vaporous hydrogen-hydrocarbon stream from said process; and (7) a conduit for transporting a hydrogen-containing feed stream in communication with said separation zone vaporous effluent conduit downstream of said vent conduit; said control method consisting of:

(a) sensing the hydrogen concentration of the entire reaction zone product in said reaction zone effluent conduit before any separation of said liquid product component from said vaporous hydrogen-hydrocarbon component;

(b) comparing said sensed hydrogen concentration with a predetermined selected concentration of hydrogen and developing a signal correlating thereto; and (c) transmitting said developed signal to said variable flow restriction device in said vent conduit to either: increase hydrogen concentration in said recycle stream when said sensed hydrogen of step (a) is smaller than said predetermined hydrogen concentration of step (b) by decreasing the degree of restriction of said variable flow restriction device in said vent conduit or decrease hydrogen concentration in said recycle stream when said sensed hydrogen of step (a) is larger than said predetermined hydrogen concentration of step (b) by increasing the degree of restriction of said variable flow restriction device in said vent conduit.

2. The method of claim 1 further characterized with respect to step (a) in that said concentration of hydrogen is expressed in terms of partial pressure.

3. The method of claim 1 further characterized with respect to step (a) in that said concentration of hydrogen is obtained by means of an apparatus which directly measures partial pressure.

4. The method of claim 1 further characterized with respect to step (a) in that said concentration of hydrogen is obtained by means of measuring the total pressure of said feed stream, measuring the mole fraction of hydrogen in said feed stream, then multiplying mole fraction times total pressure, the product being partial pressure.

5. The method of claim 1 further characterized in that said hydrocarbon reaction zone is a hydrogenation unit.

6. The method of claim 1 further characterized in that said hydrocarbon reaction zone is a hydrodealkylation unit.

7. The method of claim 1 further characterized in that said hydrocarbon reaction zone is a hydrodesulfurization unit.

8. The method of claim 1 further characterized in that said hydrocarbon reaction zone is a hydrocracking unit.

* * * * *